United States Patent [19]

Worrell et al.

[11] Patent Number: 4,801,922

[45] Date of Patent: Jan. 31, 1989

[54] LOW TEMPERATURE ALARM

[76] Inventors: Darhl R. Worrell, 211 Old Mill Rd., Dardanelle, Ark. 72834; George Spector, 233 Broadway, RM 3815, New York, N.Y. 10007

[21] Appl. No.: 49,541

[22] Filed: May 14, 1987

[51] Int. Cl.[4] ..... G08B 21/00

[52] U.S. Cl. ..... 340/586; 340/573; 340/584; 340/594; 340/693

[58] Field of Search ..... 340/586, 594, 573, 584, 340/691

[56] References Cited

U.S. PATENT DOCUMENTS

| | | | |
|---|---|---|---|
| 3,745,545 | 7/1973 | Darbo | 340/586 |
| 3,810,139 | 5/1974 | Fergusson | 340/586 |
| 4,212,007 | 7/1980 | Reyes et al. | 340/691 |

*Primary Examiner*—Glen R. Swann, III

[57] ABSTRACT

An alarm device has a housing provided with visual and audio alarm indicators which give a warning when the temperature of a particular location is at a predetermined relatively low temperature to prevent freezing and wherein a modification is provided which has a switch that activates an enhanced audio alarm responsive to a predetermined temperature lower than the first referred to temperature.

2 Claims, 1 Drawing Sheet

LOW TEMPERATURE ALARM

BACKGROUND OF THE INVENTION

The instant invention relates generally to alarms and more specifically it relates to a temperature alert device.

Numerous alarms have been provided in prior art that are adapted to be responsive to temperature changes. For example, U.S. Pat. Nos. 2,982,949; 3,745,545 and 3,810,139 are all illustrative of such prior art. While these units may be suitable for the particular purpose to which they address, they would not be as suitable for the purpose of the present invention.

SUMMARY OF THE INVENTION

A primary object of the present invention is to provide a temperature alert device that will overcome the shortcomings of the prior art devices.

Another object is to provide a temperature alert device that will warn a person by a visual and audio alarm of lowering temperatures so as to prevent frostbite and freezing to death.

An additional object is to provide a temperature alert device that is portable and can be adjusted to compensate for varying temperature conditions.

A further object is to provide a temperature alert device that is simple and easy to use.

A still further object is to provide a temperature alert device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
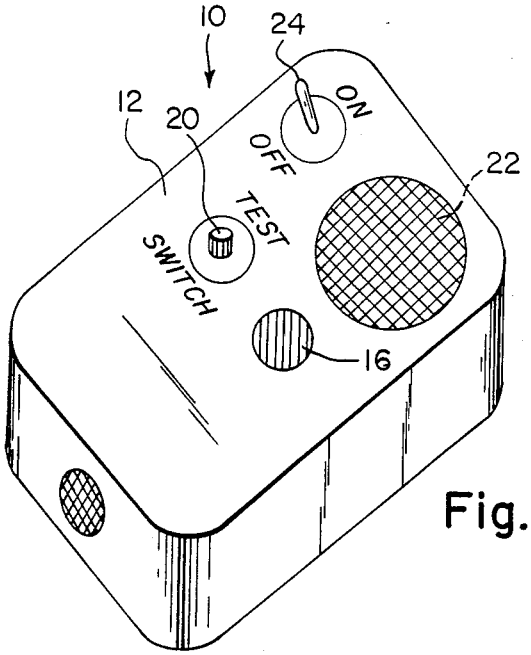
FIG. 1 is a perspective view of the invention.
Figure 2:
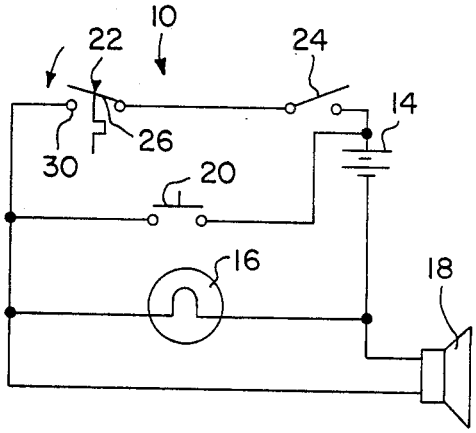
FIG. 2 is a schematic diagram of the wiring circuit.

Turning now descriptively to the drawings, in which similar reference characters denote similar elements throughout the several views, FIGS. 1 and 2 illustrate a temperature alert device 10 consisting of a housing 12 fabricated out of nonconductive material. A battery 14 is placed within the housing 12 to introduce a source of electrical current. A visual alarm indicator 16 is connected in series to the battery 14 and an audio alarm indicator 18 is also connected in series to the battery 14. A test switch 20 is electrically connected in parallel between the battery 14 and the visual alarm indicator 16 and the audio alarm indicator 18. When the test switch 20 is manually closed both the visual alarm indicator 16 and the audio alarm indicator 18 will operate thus proving the battery 14 is functioning. A thermostatic switch 22 within the housing 12 is electrically connected in parallel between the battery 14 and the visual alarm indicator 16 and the audio alarm indicator 18. The thermostatic switch 22 will activate the visual alarm indicator 16 and the audio alarm indicator 18 when the temperature drops to a predetermined level as set in the thermostatic switch 22. An on-off switch 24 is also electrically connected in series between the battery 14 and thermostatic switch 22 so as to be manually operated to turn the source of electric current on and off.

The visual alarm indicator 16 is a light bulb while the audio alarm indicating 18 is a horn. The thermostatic switch 22 includes a bimetallic disc 26 fastened at one end with an nonconductive screw 28 to the housing 12, as shown in FIG. 4, with one contact 30 positioned at an intermediate point adjacent the disc , as shown in FIGS. 3 and 4.

Figure 3:
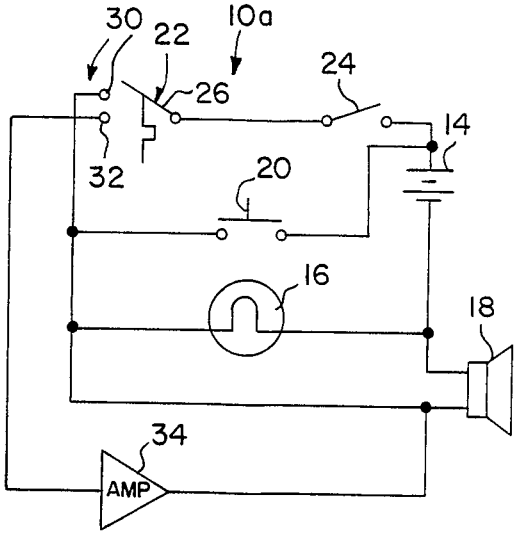
FIG. 3 is a schematic diagram of a modified wiring circuit having dual contacts and an amplifier therein.

FIG. 3 shows a modified temperature alert device 10a similar to device 10 in FIG. 2, wherein the thermostatic switch 22 includes a second contact 32 located adjacent to distal end of said disc. An amplifier 34 is also provided within the housing 12 and is electrically connected between the second contact 32 in the thermostatic switch 22 and the horn 18. When the temperature drops to a lower predetermined level as set in the thermostatic switch 22, the amplifier 34 will be activated to increase the volume of the horn 18.

Figure 4:
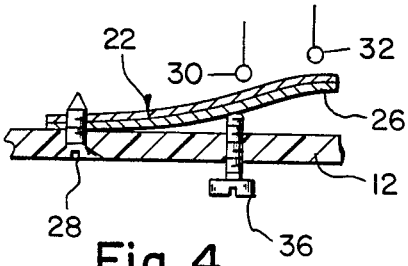
FIG. 4 is a cross sectional view of the double thermal disc/plate with adjustable screw.

As shown in FIG. 4, an adjustment screw 36 fabricated out of nonconductive material is threaded through the housing 12 to make contact with the bimetallic disc 26 so as to change the position of the bimetallic disc relative to the first and second contacts 30 and 32 controlling the temperature at which the thermostatic switch 22 will be caused to operate.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A temperature alert device which comprises:

(a) a housing fabricated out of non-conductive material;

(b) a battery within said housing to introduce a source of electric current;

(c) a visual alarm indicator within said housing electrically connected in series to said battery;

(d) an audio alarm indicator within said housing electrically connected in series to said battery;

(e) a test switch within said housing electrically connected between said battery and said indicators so when said test switch is manually closed, said visual alarm indicator and said audio alarm indicator will operate, thus proving said battery is functioning;

(f) a thermostatic switch within said housing electrically connected between said battery and said indicators so as to activate said visual alarm indicator and said audio alarm indicator when the temperature drops to a predetermined level as set in thermostatic switch; and (g) an on-off switch within said housing electrically connected between said battery and said thermostatic switch so as to be manually operated to turn the source of electric current on and off, wherein said visual alarm indicator is an electric light bulb, said audio alarm indicator is a horn, and said thermostatic switch includes a bimetallic disc fastened at one end to said housing adapted to engage a contact provided adjacent an intermediate point spaced from said one end, wherein (h) said thermostatic switch includes a second contact at a distal end of said disc spaced from the first said contact and further including (i) an amplifier within said housing electrically connected between said second contact in said thermostatic switch and said horn whereby when temperature drops to a lower predetermined level as set in said thermostatic switch, said amplifier will be activated to increase the volume of said horn.

2. A temperature alert device as recited in claim 1, further comprising an adjustment screw fabricated out of non-conductive material and threaded through said housing to make contact with said bimetallic disc to control the temperature at which said thermostatic switch will be caused to operate.

* * * * *